United States Patent [19]

Fournier et al.

[11] Patent Number: 4,944,254

[45] Date of Patent: Jul. 31, 1990

[54] DEVICE FOR SUSPENDING HORIZONTAL HEAT EXCHANGE TUBES ON A VERTICAL CARRIER TUBE, AND A METHOD OF MANUFACTURING THE DEVICE

[75] Inventors: Jean Fournier, Rochefort en Yvelines; Gilbert Delsol, Cernay la Ville, both of France

[73] Assignee: Societe Anonyme dite : STEIN INDUSTRIE, Velizy Villacoublay, France

[21] Appl. No.: 423,280

[22] Filed: Oct. 18, 1989

[30] Foreign Application Priority Data

Oct. 18, 1988 [FR] France ..... 88 13703

[51] Int. Cl.[5] ..... F22B 37/06; F22B 37/10

[52] U.S. Cl. ..... 122/511; 29/890.051; 122/510

[58] Field of Search ..... 122/510, 511, 235 D, 122/493; 285/61; 138/106, 107; 165/178, 67; 29/157.4

[56] References Cited

U.S. PATENT DOCUMENTS

| | | | |
|---|---|---|---|
| 3,265,044 | 8/1966 | Juchtern | 122/510 |
| 3,896,771 | 7/1975 | Chayes et al. | 122/510 |
| 4,682,568 | 7/1987 | Green et al. | 122/511 X |
| 4,756,278 | 7/1988 | Fournier | 122/511 |
| 4,848,452 | 7/1989 | McDonald et al. | 122/511 X |

FOREIGN PATENT DOCUMENTS

| | | |
|---|---|---|
| 0030025 | 6/1981 | European Pat. Off. . |
| 743474 | 11/1943 | Fed. Rep. of Germany . |
| 1926614 | 11/1970 | Fed. Rep. of Germany . |

*Primary Examiner*—Edward G. Favors

*Attorney, Agent, or Firm*—Sughrue, Mion, Zinn, Macpeak & Seas

[57] ABSTRACT

A device for suspending horizontal heat exchange tubes (7, 8) on a vertical carrier tube (1) comprises a bottom support sleeve (2) welded at its bottom edge around the support tube, a top support sleeve (4) having its bottom edge resting on the top edge of the bottom support sleeve, said top support sleeve being provided on its sides with two half-shells (5, 6) of radius of curvature slightly greater than that of the horizontal tubes, and add-on half-shells (9, 10) of radius of curvature slightly greater than that of the horizontal tubes, welded edge-to-edge (19, 21; 20, 22) to the half-shells fixed to the top sleeve, thereby forming collars which clamp the horizontal heat exchange tubes on either side of the vertical carrier tubes. A method of manufacturing the device.

3 Claims, 1 Drawing Sheet

DEVICE FOR SUSPENDING HORIZONTAL HEAT EXCHANGE TUBES ON A VERTICAL CARRIER TUBE, AND A METHOD OF MANUFACTURING THE DEVICE

The present invention relates to a device for suspending horizontal heat exchange tubes on a vertical carrier tube, and to a method of manufacturing it.

In French patent FR-A-No. 2 555 722 and in U.S. Pat. No. 4 706 614, the Applicant has already proposed a device for suspending a bundle of horizontal tubes in a vertical plane, the device comprising pairs of vertical tubes provided on their sides facing each other with half-fins profiled to include circular-shaped notches with a radius that is slightly greater than that of the tubes in the bundle, and at the same spacing as said tubes, being separated by tongues of width which is sufficiently great to ensure good support for the tubes of the bundle and sufficiently small to ensure good thermal conduction from their edges to their zones where the are welded to the corresponding vertical tubes. In such a device, the horizontal tubes are not connected to the vertical supporting tubes by any kind of welding and they therefore have a certain amount of freedom to move relative to the fins. When such a device is installed in an enclosure in which it is subjected to vibration, the horizontal tubes may be damaged in the long run by repeated shocks against the fins. This gives rise to the tubes being worn, and finally being punctured, particularly when they are immersed in an abrasive medium, e.g. including ash or a fluidized bed.

In patent document FR-A-No. 2 622 963, dated Nov. 10, 1987, the Applicant has also proposed a device for suspending a panel of hair-pin shaped horizontal tubes in a vertical plane by means of vertical tubes suspended from a rigid structure having a fluid flowing therethrough which is cooler than the fluid in which the panel is immersed, the vertical tubes lying in a vertical plane close to that of a panel and being fixed to the horizontal lengths of the hair-pin shaped tubes by link pieces welded firstly to a length of horizontal tube and secondly to a vertical tube, in both cases along a generator line of the corresponding tube. However, since the connection between the horizontal tubes and the vertical tubes is then rigid, the vibrations to which the tubes may be subjected run the risk in the long run of destroying the weld fillets and then of giving rise to damage and possibly, puncturing of the tubes.

The object of the present invention is to provide a device for suspending horizontal heat exchange tubes on a vertical carrier tube, which denies the horizontal tubes freedom to vibrate with large amplitude, but which does not connect the horizontal and vertical tubes rigidly by weld fillets that run the risk of breaking in the long run.

The device of the invention is characterized in that it comprises a bottom support sleeve welded at its bottom edge around the support tube, a top support sleeve having its bottom edge resting on the top edge of the bottom support sleeve, said top support sleeve being provided on its sides with two half-shells of radius of curvature slightly greater than that of the horizontal tubes, and add-on half-shells of radius of curvature slightly greater than that of the horizontal tubes, welded edge-to-edge to the half-shells fixed to the top sleeve, thereby forming collars which clamp the horizontal heat exchange tubes on either side of the vertical carrier tubes.

Preferably, one or other of the facing half-shells (carried by the top or add-on sleeve) includes thin rims that engage beneath a further-out thick rims of the other half-shell, and in that the weld fillet is made between said further-out thick rim and the edge of the facing half-shell beyond its thin rim.

A device for suspending two horizontal tubes from a vertical carrier tube, and the method of manufacturing the device are described below by way of example and with reference to the figures of the accompanying drawing.

Figure 1:
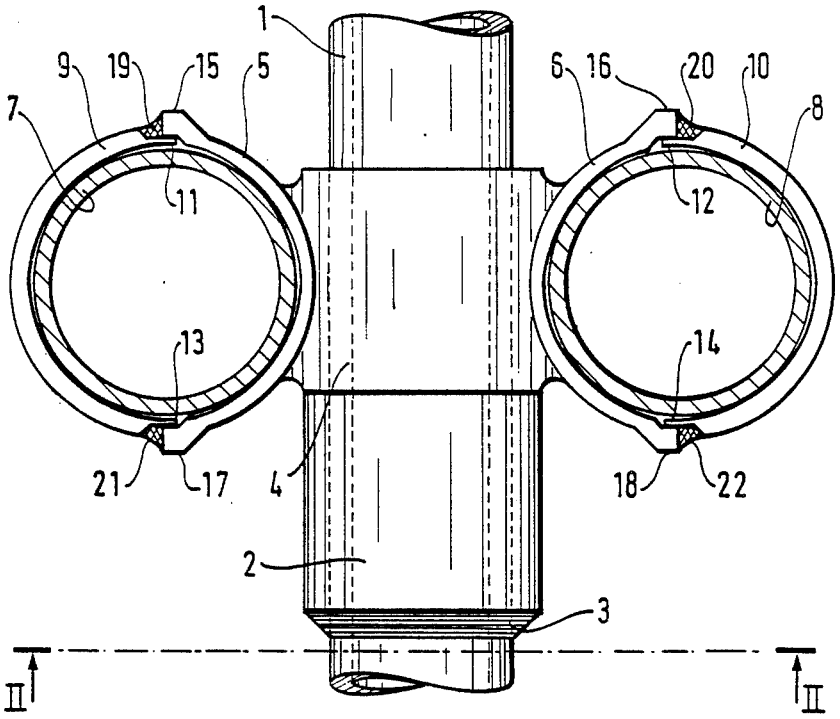
FIG. 1 shows the suspension device in elevation, with the horizontal tubes in section in front of the diametrical plane of the vertical tube, on axis I—I of FIG. 2.
Figure 2:
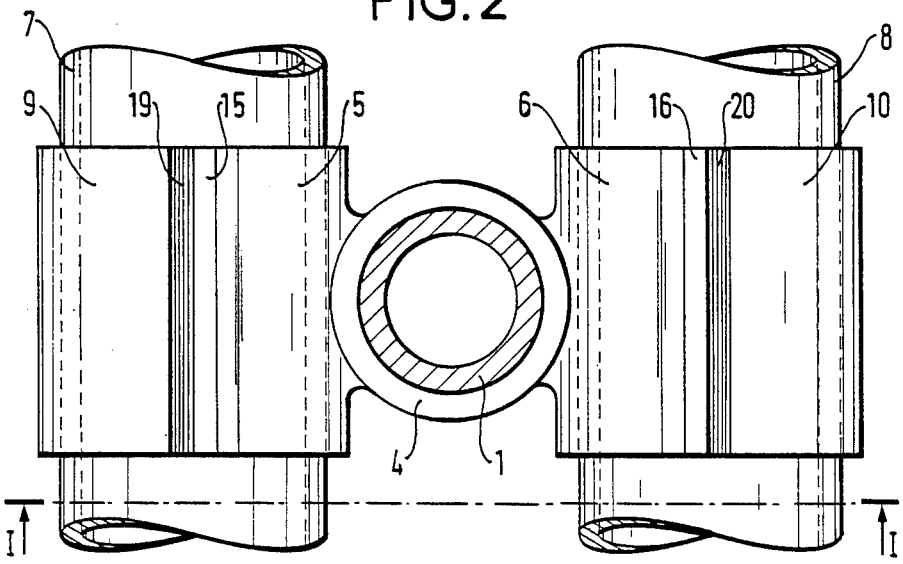
FIG. 2 shows the same device in plane view seen from above, with the vertical tube being shown in section above the plane containing the axes of the horizontal tubes, on axis II—II of FIG. 1.

A bottom support sleeve 2 is welded on vertical tube 1 by a weld fillet 3 running round the bottom edge of the sleeve. A top support sleeve 4 is threaded over the vertical tube and its bottom edge rests against the top edge of the bottom sleeve 2. The top support sleeve has two fins constituted by respective horizontal axis half-shells 5 and 6 of radius of curvature slightly greater than that of the horizontal tubes to be supported.

With the horizontal tubes 7 and 8 applied against the half-shells 5 and 6, add-on half-shells 9 and 10 of radius of curvature slightly greater than that of the horizontal tubes are applied thereto without play in order to make contact along their top and bottom edges with the corresponding edges of the half-shells connected to the top support sleeves. The add-on half-shells have thin rims 11 and 13 and 12 and 14 respectively, which engage beneath the thicker rims 15 and 17 and 16 and 18 respectively of the half-shells 5 and 6 fixed to the support sleeve 4.

The add-on half-shells are then welded to the half-shells fixed to the top support sleeve, between the thick rims of the fixed sleeves and the edges of the add-on shells over their thin rims, thereby ensuring that the horizontal tubes are not bonded to the weld fillets (19 and 21 and 20 and 22). After welding, shrinkage jams the horizontal tubes between the half-shells. The tubes are thus firmly held by the collars constituted by the assembled half-shells in the vicinity of the vertical tube, while nevertheless not being fixed by means of a weld fillet.

When the heat exchange tubes are required to come into contact with corrosive gases at high temperature, these tubes and the supporting half-shells should be made of refractory steel having high nickel and chromium content.

We claim:

1. A device for suspending horizontal heat exchange tubes (7, 8) on a vertical carrier tube (1), the device being characterized in that it comprises a bottom support sleeve (2) welded at its bottom edge around the support tube, a top support sleeve (4) having its bottom edge resting on the top edge of the bottom support sleeve, said top support sleeve being provided on its sides with two half-shells (5, 6) of radius of curvature slightly greater than that of the horizontal tubes, and add-on half-shells (9, 10) of radius of curvature slightly greater than that of the horizontal tubes, welded edge-to-edge (19, 21; 20, 22) to the half-shells fixed to the top sleeve, thereby forming collars which clamp the horizontal heat exchange tubes on either side of the vertical carrier tubes.

2. A device according to claim 1, characterized in that one or other of the facing half-shells (carried by the top or add-on sleeve) includes thin rims (11, 13: 12, 14,) that engage beneath a further out thick rims (15, 17; 16, 18) of the other half-shell, and in that the weld fillet (19, 21; 20, 22) is made between said further out thick rim and the edge of the facing half-shell beyond its thin rim.

3. A method of manufacturing a device for suspending horizontal heat exchange tubes on a vertical tube, comprising a bottom support sleeve welded at its bottom edge around the support tube, a top support sleeve (4) having its bottom edge resting on the top edge of the bottom support sleeve, said top support sleeve being provided on its sides with two half-shells (5, 6) of radius of curvature slightly greater than that of the horizontal tubes, and add-on half-shells (9, 10) of radius of curvature slightly greater than that of the horizontal tubes, welded edge-to-edge (19, 21; 20, 22) to the half-shells fixed to the top sleeve, thereby forming collars which clamp the horizontal heat exchange tubes on either side of the vertical carrier tubes, the method being characterized in that a bottom support (2) is welded to the vertical tube (1) around the bottom edge of the bottom sleeve, a top support sleeve (4) is threaded on the vertical tube over the bottom support sleeve, the top support sleeve being provided with two side half-shells (5, 6) of radius of curvature slightly greater than that of the horizontal tubes, the horizontal tubes (7, 8) are applied against said half-shells, add-on half-shells (9. 10) of radius of curvature slightly greater than that of the horizontal tubes are applied against the horizontal tubes facing the side half-shells and meeting them edge-to-edge, thereby clamping the tubes between the half-shells, and the facing edges of the add-on half-shells and the side half-shells (19, 21; 20, 22) are welded together.

* * * * *